United States Patent [19]

Dubois

[11] 4,164,109

[45] Aug. 14, 1979

[54] METHOD AND DEVICE FOR A TIGHT PACKING UNDER A THERMOPLASTIC AND THERMOFORMABLE FILM OF PRODUCTS REQUIRING AN ABSOLUTE PROTECTION

[76] Inventor: Jacques R. N. Dubois, 31, rue Jouvenet, 75016 Paris, France

[21] Appl. No.: 864,628

[22] Filed: Dec. 27, 1977

[30] Foreign Application Priority Data

Oct. 24, 1977 [FR] France ..... 77 31938

[51] Int. Cl.[2] ..... B65B 31/04

[52] U.S. Cl. ..... 53/427; 53/433; 53/509; 53/511

[58] Field of Search ..... 53/22 A, 112 A, 427, 53/509

[56] References Cited

U.S. PATENT DOCUMENTS

| | | | |
|---|---|---|---|
| 2,712,208 | 7/1955 | Campbell | 53/112 A X |
| 2,991,600 | 7/1961 | Lancaster | 53/112 A X |
| 3,020,686 | 2/1962 | Rueckert et al. | 53/112 A X |
| 3,830,365 | 8/1974 | Krueger et al. | 53/112 A X |

*Primary Examiner*—Travis S. McGehee

*Attorney, Agent, or Firm*—Hauke and Patalidis

[57] ABSTRACT

While thermoforming an article skin-wrap packaging, the article being disposed on an air-tight supporting plate firmly applied on an evacuated chamber and a plastic film displaced parallel to the supporting plate to firmly engage the article and the supporting plate, vacuum is provided in the wrapping by means of at least one suction tube or nozzle temporarily placed between the supporting plate and the film.

6 Claims, 7 Drawing Figures

METHOD AND DEVICE FOR A TIGHT PACKING UNDER A THERMOPLASTIC AND THERMOFORMABLE FILM OF PRODUCTS REQUIRING AN ABSOLUTE PROTECTION

BACKGROUND OF THE INVENTION

The present invention relates to a method and a device providing a tight skinwrapped packaging under a thermoplastic and thermoformable film of products requiring an absolute protection.

There are already known packings formed by a thermoplastic film, preferably of a tranparent material, placed on an article placed on a porous or apertured support. This method is already used for protecting and presenting under an attractive aspect articles offered for sale. However, the porosity or the apertures of the supporting material, required for the passage of the evacuated air for applying the thermoplastic film, do not permit to obtain hermetically sealed packages.

Consequently, the present invention has for its object to cope with the disadvantage of the known packings, by providing a method and a device which enable to obtain through applying a thermoplastic film, display packages which are totally air-tight and ensure to the articles therein an absolute protection against any outside attacks such as microbial contamination, corrosion and the like. The packages realized according to the method of the present invention are particularly advantageous for food products, as well as for previously sterilized articles and similar.

SUMMARY OF THE INVENTION

The method according to the invention is characterized in that during the thermoforming of a skinwrapped package formed by applying a stretchable plastic film on an article disposed on a supporting plate with no porosities or perforations placed on the plate of an evacuated chamber, a vacuum is created in the wrapping itself by means of at least on suction tube temporarily engaged between the supporting plate and the plastic film.

The device for carrying into effect the method of the invention is characterized in that a conventional thermoforming machine connected to a vacuum pump is provided with at least one vacuum pin formed by a small tube which is automatically introduced between the plastic film and the supporting plate, said vacuum pin being automatically removed from between the plastic film and the supporting plate at the end of the process.

Various other features of the invention are moreover shown in the following description.

Embodiments of the present invention are shown, as non restrictive examples, in the accompanying drawings in which:

DETAILED DESCRIPTION OF THE PREFERRED EMBODIMENTS

Figure 1:
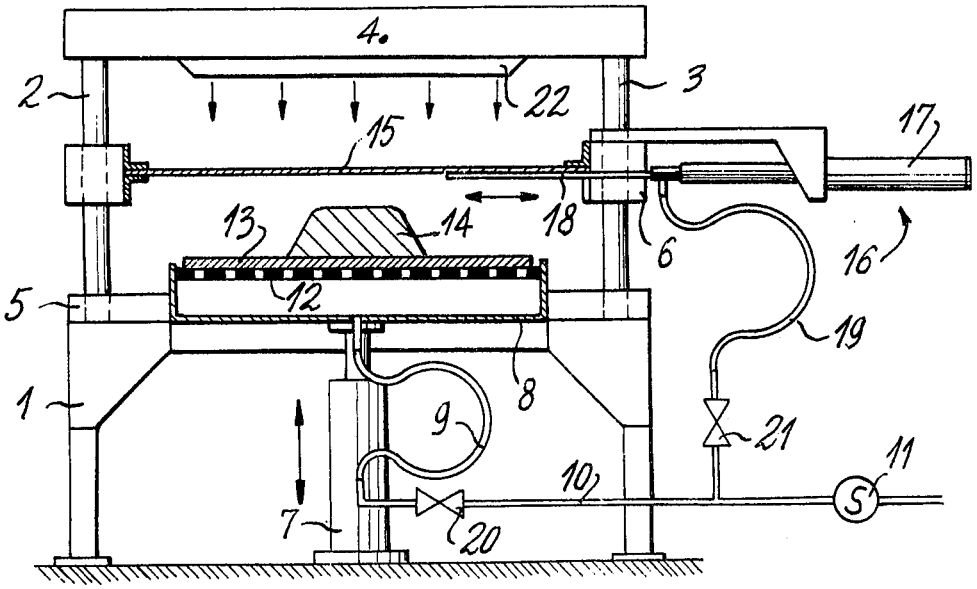
FIG. 1 is a diagrammatic partial cross-sectional front view of a machine for carrying into effect the method of the invention and showing the first operative step.
Figure 2:
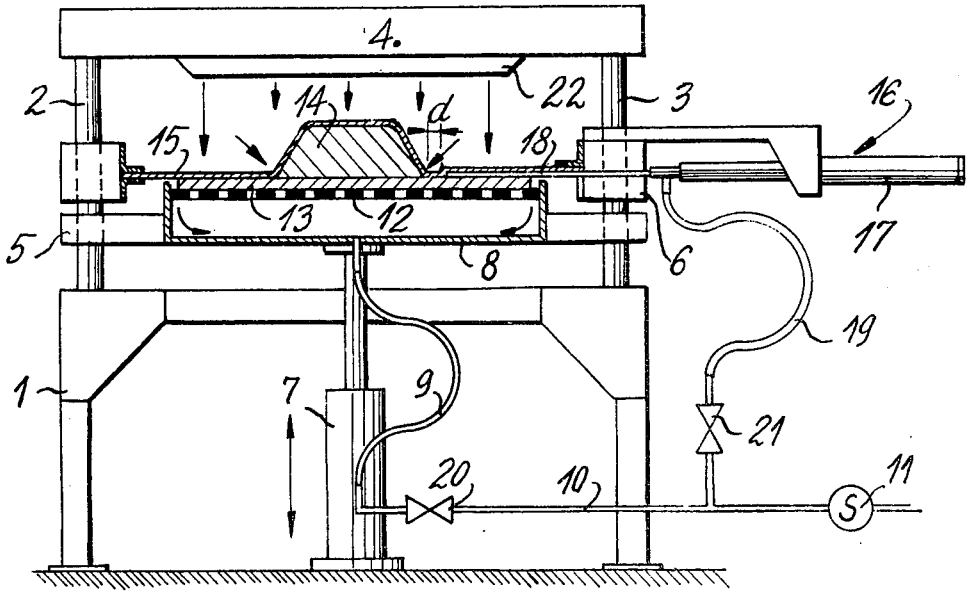
FIG. 2 is a view similar to FIG. 1 but showing the final operative step.
Figure 3:
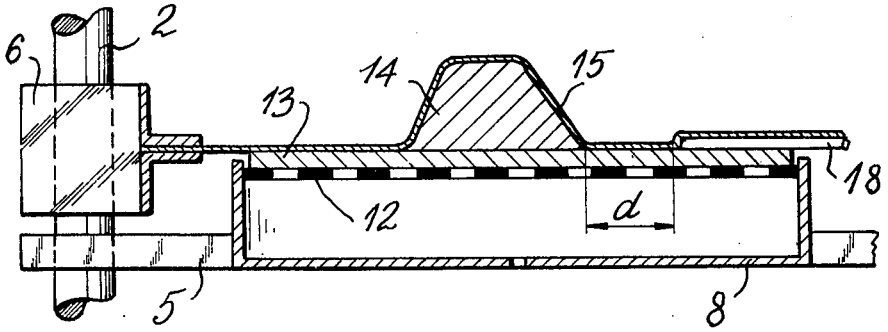
FIG. 3 is an enlarged cross-section showing the tooling necessary for the realization of the method of the present invention.

For carrying into effect the method according to the invention, there can be used a thermoforming machine of a conventional type such as that represented diagrammatically in FIGS. 1 and 2. This machine is mainly constituted by a frame 1, four columns 2, 3, **2*a* and 3*a* (FIGS. 4 and 5) with only two columns 2 and 3 being shown in FIGS. 1 and 2, an end plate 4, a mobile plate 5, and a device 6** which is adjustable in height.

The mobile plate 5, whose upwards or downwards movement is guided by the columns 2, **2*a*, 3, 3*a*, is controlled by a jack or similar means 7, comprises a caisson or chamber 8 connected through a flexible duct 9 and a rigid duct 10 to a vacuum pump 11. In the upper portion of the chamber 8, and slightly in recess relatively to its upper edge, there is provided a perforated plate 12 on which is placed the support 13 of the article 14** to be packaged.

The device 6 is provided, on one hand, to maintain the film stretched and, on the other hand, to be used as a support for at least one vacuum pin 16 which is formed by a cylinder or similar means 17 and a small tube 18 connected by means of a flexible duct 19 to the rigid duct 10 coming from the vacuum pump 11. The duct 10 has two valves 20, 21 controlling the vacuum both at the level of the chamber 8 and at the level of the pin 16. Due to the fact that the device 6 is adjustable in height it can, depending on the softening point of the thermoplastic film, be brought more or less close to a heat source 22 formed, for instance, by an infrared emitter.

Figure 6:
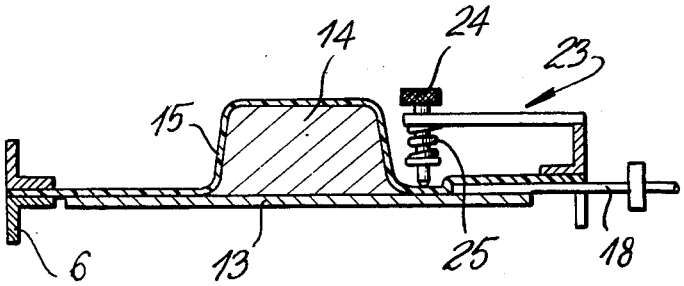
FIGS. 6 and 7 are cross-sectional views showing two different means to crush the evacuation channel.
Figure 7:
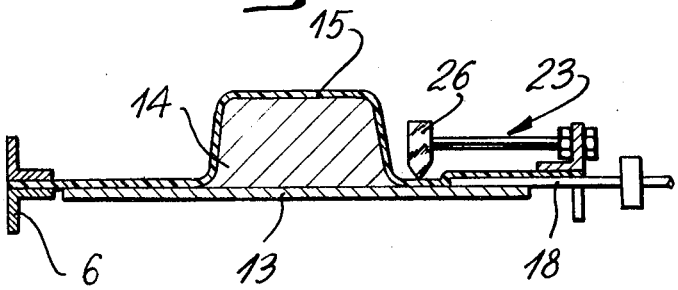
Figure 4:
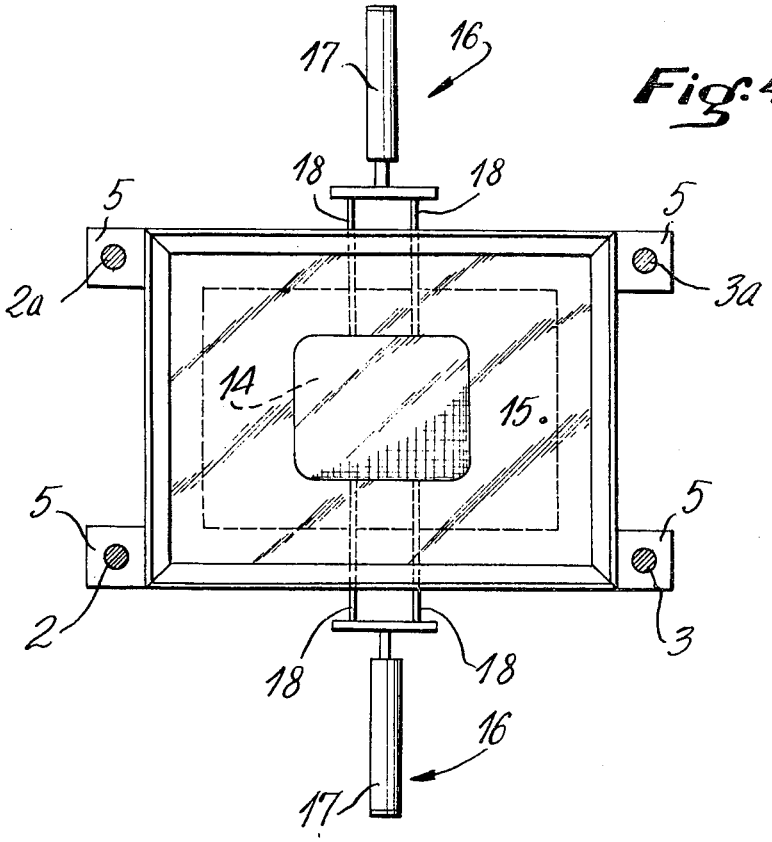
FIGS. 4 and 5 are top views of the forming plate showing various arrangements of vacuum pins and of pins for injection of rare gases.
Figure 5:
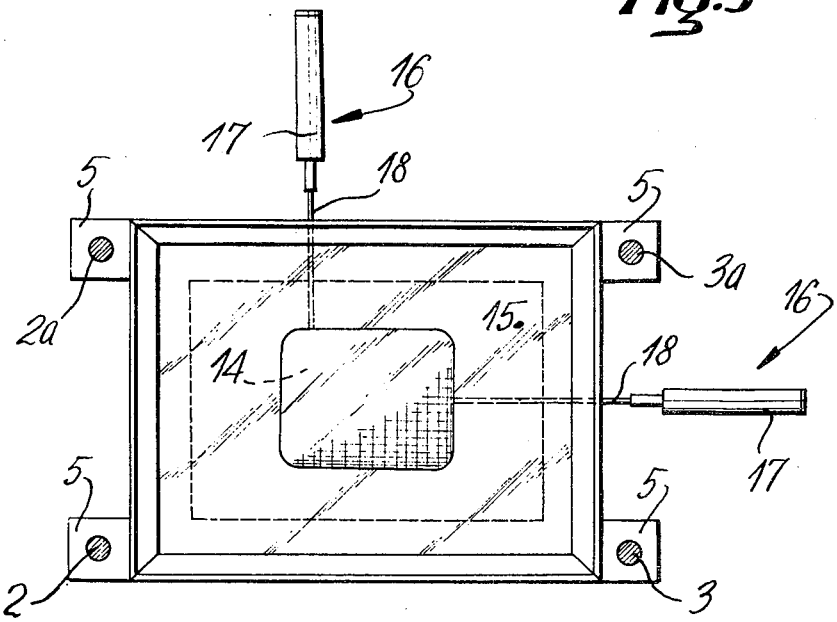

The operation of the device of the invention is as follows: the support 13 in the form of a supporting plate 1, made of cardboard or other air-tight material, is placed on the perforated plate 12 of the chamber 8 where it is firmly held by the vacuum created in the chamber 8 which communicates with the vacuum pump 11 because of the opening of the valve 20. Then, the article 14 to be packed is placed on the support 13 and, after having heat softened the film 15 by means of the heat source 22, the mobile plate 5 is taken upwards, thus the film 15 takes the shape of the article 14 and is marginally applied on the supporting plate 13, except where the small evacuation tube 18 of the vacuum pin 16 is disposed. By letting between the article 14 and the end of the tube 18 a suitable distance d, the film 15 automatically engages the support 13 at the end of the vacuum step and upon removal of the tube 18. For the purpose of increasing the air tightness of the package, it is also possible to use simple mechanical means 23, i.e. either a rod 24 subjected to the force of a spring 25 (FIG. 6), or another pressing element 26 pressing the film 15 on the support 13 as soon as the tube 18 of the pin 16 is removed. These pressing means 23 become particularly necessary when it is desired to inject into the packing a rare gas before removing the vacuum pin. For that purpose there is no objection to using various vacuum pins, as shown in FIGS. 4 and 5.

In actual practice, it is possible to use thermoforming machines of various types to obtain the same result. For example, a machine may be used having a fixed plate but in which the film and its fixing means move from top to bottom after having preheated the film in such a way that it covers the article to be packaged.

The present invention is applicable to all packaging techniques whatever may be the nature of the film or of the support utilized. It is only important to obtain a perfect adhesion of the film on the support. For that purpose, either the film or the support is generally made self-adhesive by coating it with a varnish or with a special glue which can be heat reactivated. There can also be used two materials of same nature which can be thermosealed by a mere pressure.

The invention is not restricted to the examples as above represented and described for various modifications thereof may be made without departing from the scope of the invention as defined in the appended claims.

I claim:

1. A method for tight packaging an article under a thermoplastic and thermoformable film comprising the steps of:

placing an air-tight support on an apertured plate of a chamber and evacuating the chamber whereby the support is firmly applied onto the plate, positioning the article to be packaged on the support, placing a thermoplastic and thermoformable film in an upright sliding position in proximity to the top of the article, providing at least one suction nozzle between the support and the film, connecting said suction nozzle to a vacuum source, heating the film while simultaneously causing the film and the nozzle to be displaced in unison parallel to the support towards the article until the film engages the article and tightly wrap the article and the suction nozzle on the support, removing said suction nozzle from between the support and the film, and disconnecting said nozzle from the vacuum source.

2. The method of claim 1 wherein the film is made self-adhesive by being provided with a coating of an adhesive material which can be heated reactivated.

3. The method of claim 1 wherein the support is made self-adhesive by being provided with a coating of an adhesive material which can be heat reactivated.

4. An apparatus for forming a tight skinwrapped packaging of an article under a thermoplastic and thermoformable film comprising means for placing a thermoplastic and thermoformable film in a sliding position in proximity to the top of said article positioned on an air-tight support on an apertured plate of a chamber; means for evacuating the chamber whereby the support is firmly applied onto the plate; upright sliding means for slidingly moving the film; at least one suction nozzle in a sliding position between the support and the film; a vacuum source; means for connecting said suction nozzle to the vacuum source; heating means for heating the film; means for controlling heating of the film with a simultaneous sliding of the film and the nozzle towards the article until the film comes into wrapping engagement with the article and wrap the film on the support, and means for removing said suction nozzle from between the support and the film.

5. The apparatus of claim 4 wherein various pressing means are further provided for ensuring a tight closing of the package upon removal of said suction nozzle.

6. The apparatus of claim 4 wherein means are provided for injection of a rare gas into the package thereby contributing to the preservation of the packaged article.

* * * * *

UNITED STATES PATENT AND TRADEMARK OFFICE

CERTIFICATE OF CORRECTION

PATENT NO. : 4,164,109

DATED : August 14, 1979

INVENTOR(S) : Jacques R. N. Dubois

It is certified that error appears in the above-identified patent and that said Letters Patent are hereby corrected as shown below:

Column 4, line 7, "heated" should read -- heat --.

Signed and Sealed this

*Twenty-second* Day of *January 1980*

[SEAL]

*Attest:*

SIDNEY A. DIAMOND

*Attesting Officer*

*Commissioner of Patents and Trademarks*